US005372715A

United States Patent [19]

Maggard et al.

[11] Patent Number: 5,372,715

[45] Date of Patent: Dec. 13, 1994

[54] SIPHONAGE FLOOR DRAIN AND PORT PROTECTOR

[75] Inventors: Gerald D. Maggard, The Woodlands; Gerald L. Evans, Tomball, both of Tex.

[73] Assignee: MagDouglas, Inc., The Woodlands, Tex.

[21] Appl. No.: 165,240

[22] Filed: Dec. 10, 1993

Related U.S. Application Data

[63] Continuation-in-part of Ser. No. 826,007, Jan. 27, 1992, abandoned.

[51] Int. Cl.[5] ..... B01D 35/00

[52] U.S. Cl. ..... 210/165; 210/164; 210/166; 210/232; 4/286; 4/288; 4/290

[58] Field of Search ..... 210/163, 164, 165, 166, 210/459, 232, 248, 460, 496; 285/14; 4/286–292, 679; 405/42, 43, 45; 52/302, 303, 127.3, 127.4, 516, 743

[56] References Cited

U.S. PATENT DOCUMENTS

| | | | |
|---|---|---|---|
| Re. 24,690 | 8/1959 | Yavitch | 4/288 |
| 1,669,586 | 5/1928 | Boosey | 210/165 |
| 1,766,621 | 6/1930 | Fleming | 210/165 |
| 1,786,558 | 12/1930 | Boosey | 210/165 |
| 1,828,601 | 10/1931 | Frye | 285/14 |
| 2,626,674 | 1/1953 | Boosey | 285/14 |
| 2,859,452 | 11/1958 | Seewack | 210/165 |
| 3,071,781 | 1/1963 | Seewack | 4/286 |
| 3,420,552 | 1/1969 | Mork | 4/288 |
| 3,744,065 | 7/1973 | Yavitch | 4/146 |
| 4,146,939 | 4/1979 | Izzi | 4/288 |
| 4,423,527 | 1/1984 | Morris et al. | 4/288 |
| 4,603,890 | 8/1986 | Huppee | 285/14 |
| 4,739,524 | 4/1988 | Burd | 4/286 |
| 4,845,914 | 7/1989 | Burd | 52/741 |

*Primary Examiner*—Peter A. Hruskoci
*Assistant Examiner*—Robert James Popovics
*Attorney, Agent, or Firm*—Mary J. Gaskin

[57] ABSTRACT

A floor drain and method for its installation, such floor drain incorporating: (1) a flange clamp ring with multiple weep holes, drain tubes with siphonage drain lines, and a tongued and grooved boss, and; (2) a permeable port protector, installed over the floor drain housing and the flange clamp ring, which prevents mortar and debris from entering and clogging drainage holes while allowing water to drain.

5 Claims, 5 Drawing Sheets

SIPHONAGE FLOOR DRAIN AND PORT PROTECTOR

TECHNICAL FIELD

This is a continuation-in-part of copending application, serial number 07/826,007, filed on Jan. 27, 1992, now abandoned. The invention relates to a floor and shower drain and its installation. The field of the invention relates to plumbing fittings designed for use with waterproof liners and pre-formed pans in areas where pan liners and protected drainage are needed.

BACKGROUND OF THE INVENTION

Typically, when a floor or shower drain is installed, the shower stall sub-floor is a designated area of a concrete foundation or slab of a building. The concrete finishers seldom lay a perfectly level slab for the shower stall sub-floor. If the sub-floor is not level, when the shower pan or waterproof liner is installed around the flanged strainer, the liner will not be level and will have dips, trapping pockets of water.

Another drainage problem will occur when the mortar bed or mud bed is installed on top of the shower pan and around the flange-style drain. The mortar bed or mud bed is sloped to promote gravity-flow drainage. In addition, the drain will utilize a set of weep holes to drain off water that may seep down to the pan liner. However, when the mortar bed or mud bed is installed, the mortar or mud or other debris will run into the drainage ports and weep holes, clogging them. When the mortar hardens, inadequate drainage will result, allowing water to build up and stagnate. Extensive structural damage may result if the water pan overflows or leaks due to inadequate drainage.

A need existed for an improved floor and shower drain to overcome the problems associated with conventional drains.

Therefore, it is an object of this invention to provide an improved floor drain apparatus.

It is another object of this invention to provide an improved floor drain with drainage port protectors.

It is another object of this invention to provide an improved floor drain with a drainage port protector to keep material from clogging drainage ports and weep holes during and after installation of the drain and floor covering.

It is another object of this invention to provide an improved floor drain with siphonage leaders.

It is still another object of this invention to provide an improved floor drain that can be used with water pan liners and pre-formed pans.

It is still another object of this invention to provide an improved floor drain that can be used with or without liners.

It is still another object of this invention to provide an improved floor drain with a boss to prevent water leakage under the water pan liner at the drain and liner connection.

It is still another object of this invention to provide an improved floor drain with multiple weep holes and drainage ports, a port protector, and siphonage leaders.

SUMMARY OF THE INVENTION

The floor drain described herein is one embodiment of the invention. The floor drain has a flange clamp ring. When bolted to the floor drain housing, the flange clamp ring is compressed, creating a waterproof membrane seal between the waterproof liner and the drain housing, and the boss prevents water from seeping under the waterproof liner.

The embodiment has multiple weep holes to effectively drain off water that may get trapped on top of the waterproof liner. Tapered barb fittings attach siphonage drain lines to the flange clamp ring; siphonage drain lines drain off trapped water and allow it to flow to the existing plumbing.

Permeable caps are installed over the siphonage drain lines to keep concrete and debris from clogging and blocking drainage ports in the siphonage drain lines. The port protector caps have a wick-type design to assure water passage through the siphonage drain lines.

A port protector covers the entire flange clamp ring as well as the top of the main floor drain housing. The port protector prevents concrete and other debris from clogging and blocking drainage ports and weep holes. A contact glue strip seals the port protector to the waterproof liner. A precision cut-out area of the port protector allows the adjustable strainer to be inserted through the center of the port protector.

The embodiment also discloses a transition fitting which can be used with a pre-formed pan. The transition fitting provides a method for adapting the invention for use with other strainers and fittings.

The embodiment described herein can be installed in shower stalls, steam rooms, wash rooms, waterfalls, custom tubs, and related areas requiring waterproof and protected drainage.

DESCRIPTION OF THE PREFERRED EMBODIMENT

Figure 1:
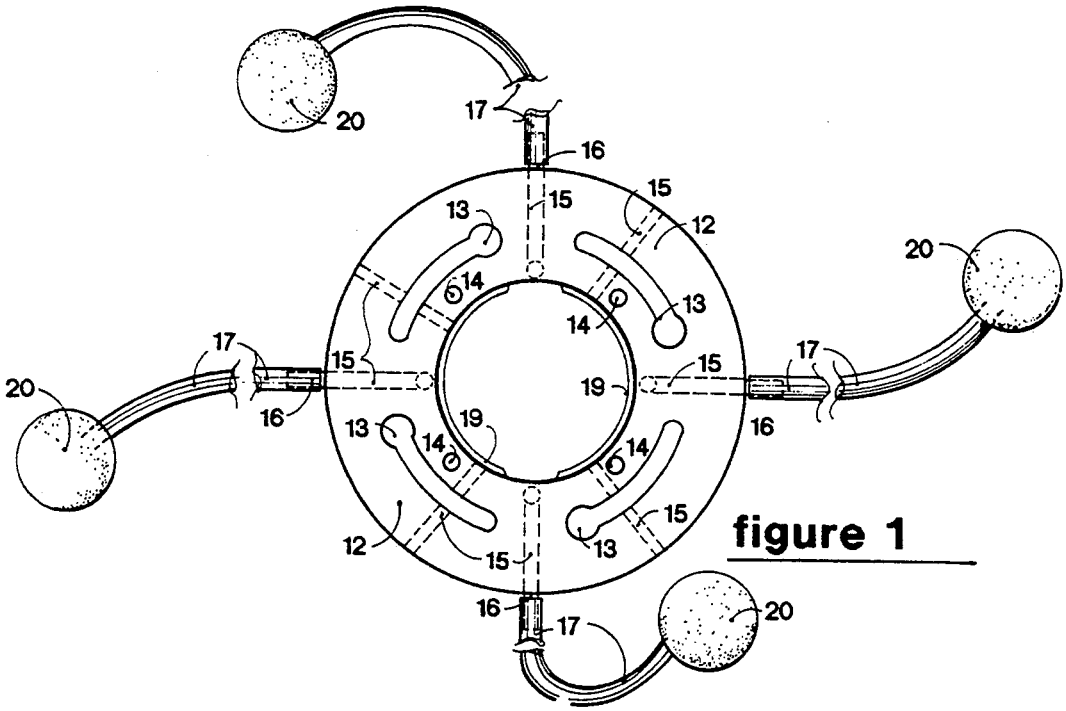
FIG. 1 a top view of the floor drain flange clamp ring with siphonage drain lines and multiple drainage ports.

In FIG. 1, the top view of the floor drain flange clamp ring, the main flange clamp ring 12 has weep holes 14 and drain ports 15 through which water can flow. Tapered barb fittings 16, which provide a watertight seal, attach one end of each of the open-ended siphonage drain lines 17 to the main flange clamp ring 12. A permeable cap 20, encloses each of the other unattached ends of the open-ended siphonage drain lines 17 to keep concrete and debris from clogging and blocking the siphonage drain lines 17 and the drain ports 15 into which they drain water. Spherical in shape, the permeable caps 20 are made from flexible, open-celled foam or sponge material, such as open-celled polyurethane. The siphonage drain lines 17 are constructed from polyurethane plastic tubing. Together, the permeable caps 20 and the siphonage drain lines 17 act as wicks, as the permeable caps 20 absorb water and other liquids trapped on top of the subfloor and shower pan liner and allow such liquids to pass through the siphonage drain lines 17 to the drain ports 15 of the plumbing drainage system. The main flange clamp ring 12 is attached to floor drain housing through bolt port entries 13.

Figure 2:
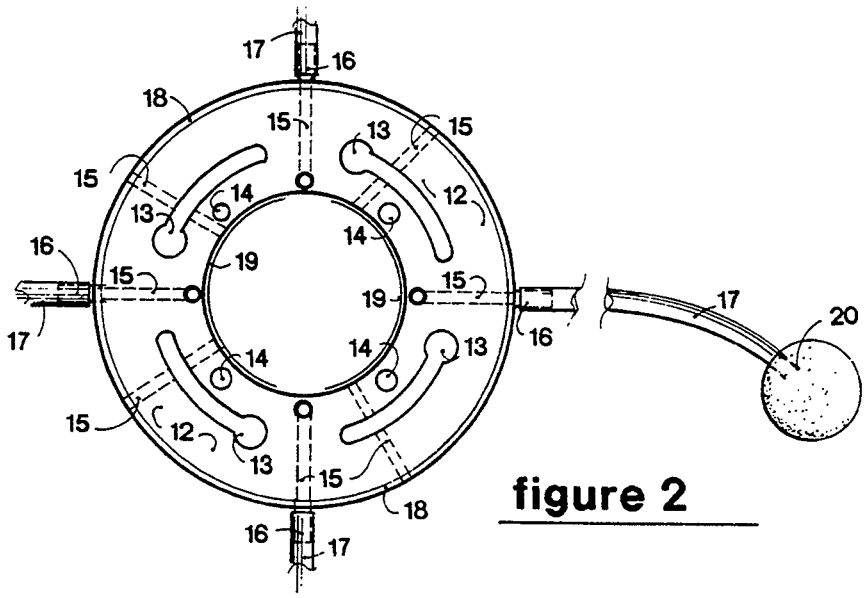
FIG. 2 is a bottom view of the floor drain flange clamp ring with siphonage drain lines and multiple drainage ports.

In FIG. 2, the bottom view of the floor drain flange clamp ring, the main flange clamp ring 12 has vertical weep holes 14 and horizontal/vertical drain ports 15 through which water can flow. Tapered barb fittings 16, which provide a water-tight seal, attach one end of each of the open-ended siphonage drain lines 17 to the main flange clamp ring 12. A permeable cap 20, as described above, encloses each of the other unattached ends of the open-ended siphonage drain lines 17 to keep concrete and debris from clogging and blocking the siphonage drain lines 17 and the drain ports 15 into which they drain water. The boss 18 of the main flange clamp ring 12 is specially tongued. The main flange clamp ring 12 has female threads 19 and is attached to the floor drain housing through bolt port entries 13.

Figure 3:
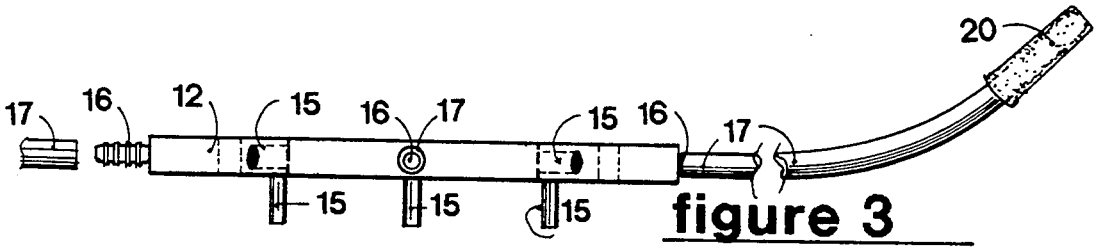
FIG. 3 is a side view of the floor drain flange clamp ring with siphonage drain lines and multiple drainage ports.

In FIG. 3, the side view of the floor drain flange clamp ring, the main flange clamp ring 12 has drain ports 15 through which water can flow. Tapered barb fittings 16, which provide a water-tight seal, attach one end of each of the open-ended siphonage drain lines 17 to the main flange clamp ring 12. A permeable cap 20, as described above, encloses each of the other unattached ends of the open-ended siphonage drain lines 17 to keep concrete and debris from clogging and blocking the siphonage drain lines 17 and the drain ports 15 into which they drain water.

Figure 4:
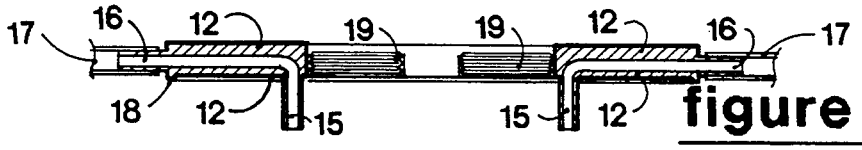
FIG. 4 is a cross-sectional view of FIG. 3.

In FIG. 4, the cross-sectional view, the main flange clamp ring 12 has drain ports 15 through which water can flow. Tapered barb fittings 16, which provide a water-tight seal, attach one end of each of the open-ended siphonage drain lines 17 to the main flange clamp ring 12. The boss 18 of main flange clamp ring 12 is specially tongued to create a waterproof membrane seal between the main flange clamp ring 12 and the waterproof liner 31, which is installed above the floor drain housing 23. The main flange clamp ring 12 has female threads 19.

Figure 5:
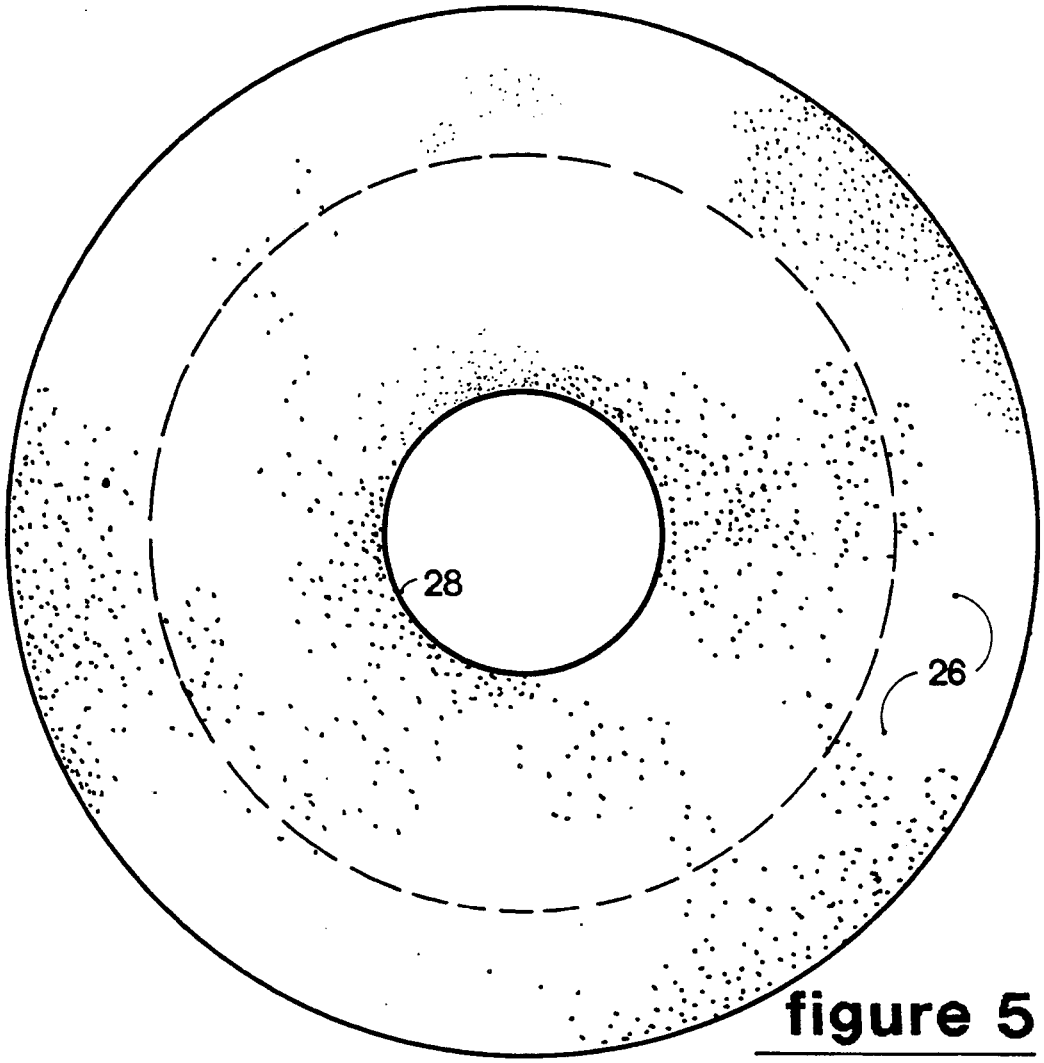
FIG. 5 is a top view of the port protector.

The flat, circular port protector 26, shown in FIG. 5, is made from permeable, flexible, open-celled, foam or sponge material, such as polyurethane foam. The port protector 26 is shaped to cover the entire flange clamp ring 26 as well as the top of the main floor drain housing 23; it has a center cutout 28 for entry of the strainer 21. The port protector 26 prevents concrete, mortar and other debris from entering and thereby clogging and blocking drain ports 15 and weep holes 14; its open-celled structure allows liquids, such as water, to pass through it to the drain ports 15 and weep holes 14 of the plumbing drainage 32.

Figure 6:
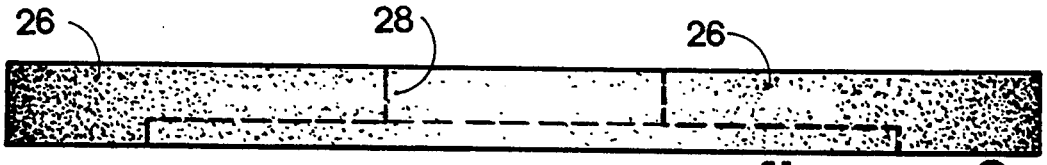
FIG. 6 is a side view of the port protector.

FIG. 6 shows a side view of the port protector 26 with its center cutout 28 and a cavity 40.

Figure 7:
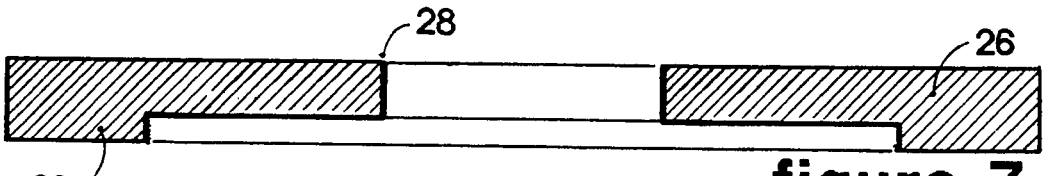
FIG. 7 is a cross-sectional view of FIG. 6

FIG. 7 shows a cross-sectional view of the port protector 26 with its center cutout 28 and a cavity 40.

Figure 8:
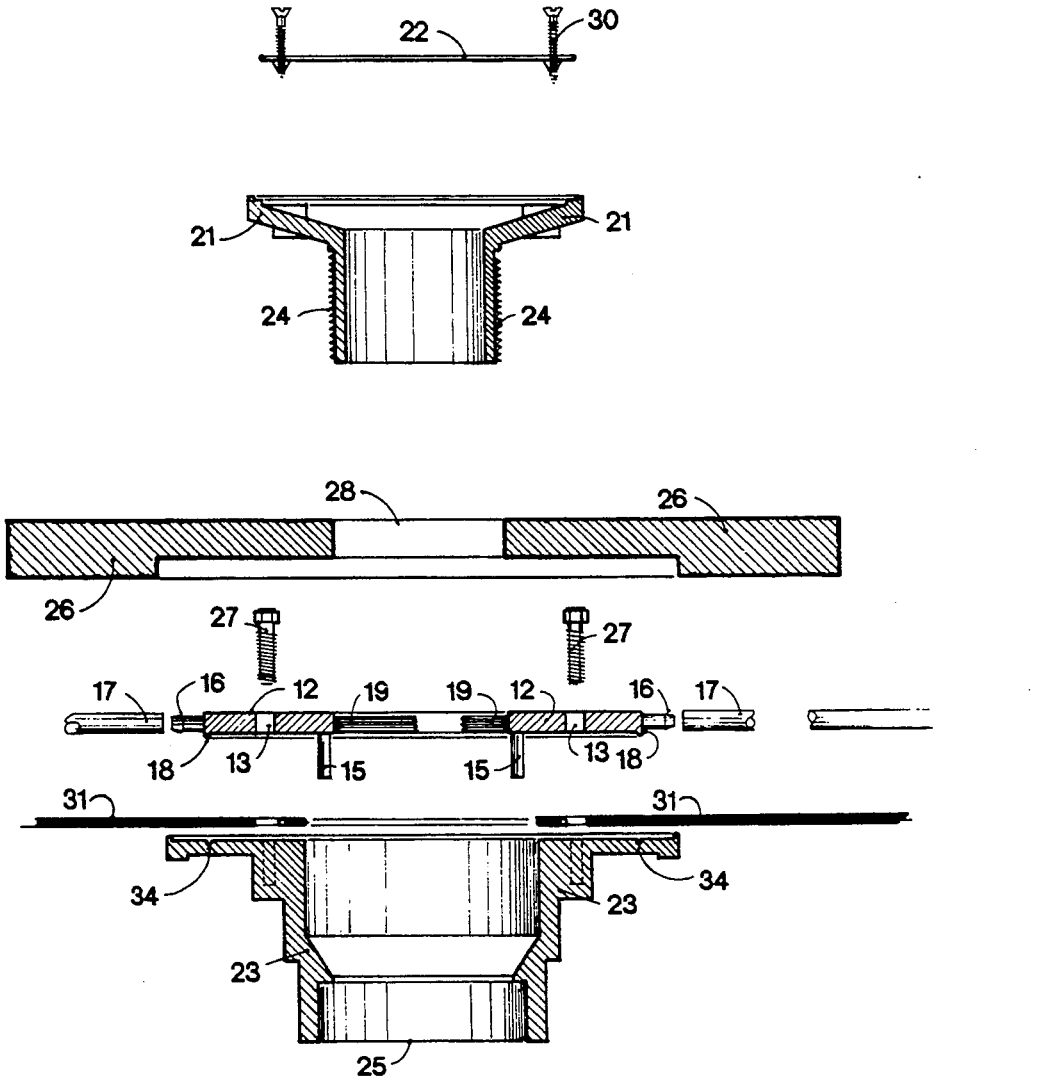
FIG. 8 is an exploded cross-sectional side view of the components of the floor drain in accordance with the preferred embodiment of the present invention.
Figure 8:
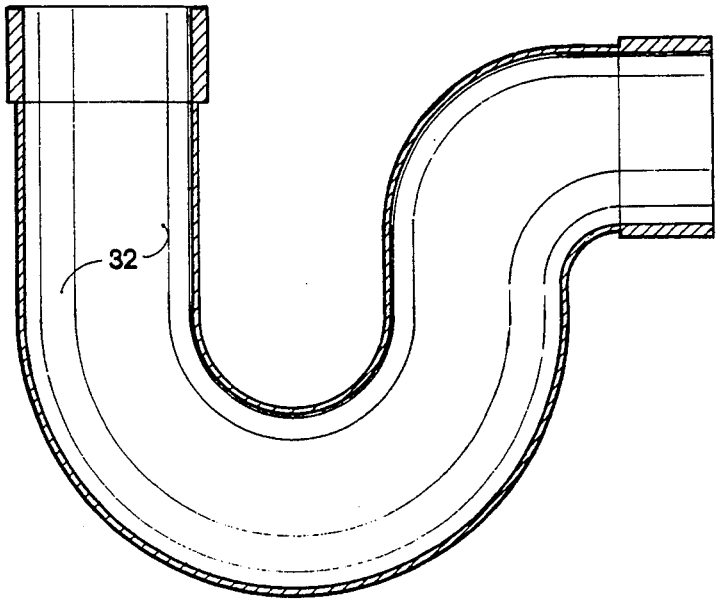

FIG. 8 provides an exploded, cross-sectional side view which illustrates the different components of the invention. At the bottom of the figure, the floor drain housing 23 is connected to existing plumbing drainage 32 by solid weld fitting 25. The boss receptacle 34 is a groove on top of the floor drain housing 23. The main flange clamp ring 12 has drain ports 15 through which water can flow. Tapered barb fittings 16, which provide a water-tight seal, attach one end of each of the open-ended siphonage drain lines 17 to the main flange clamp ring 12. The boss 18 of main flange clamp ring 12 is specially tongued to fit the grooved boss receptacle 34 to create a waterproof membrane seal between the main flange clamp ring 12 and the waterproof liner 31, which is installed above the floor drain housing 23. The main flange clamp ring 12 has female threads 19. Stainless steel flange bolts 27 pass through bolt port entries 13 to tighten the main flange clamp ring 12 to the floor drain housing 23. The port protector 26 has a center cutout 28 and a cavity 40 which is of substantially the same shape as said flange clamp ring 12. The port protector 26 covers the upper surface of the flange clamp ring 12 and its outer sidewall, with the flange clamp ring occupying the cavity 40. The adjustable strainer 21, which allows water to discharge to existing plumbing drainage 32, has male threads 24. A grate cover 22 is attached to the adjustable strainer 21 by strainer fastening bolts 30.

Figure 9:
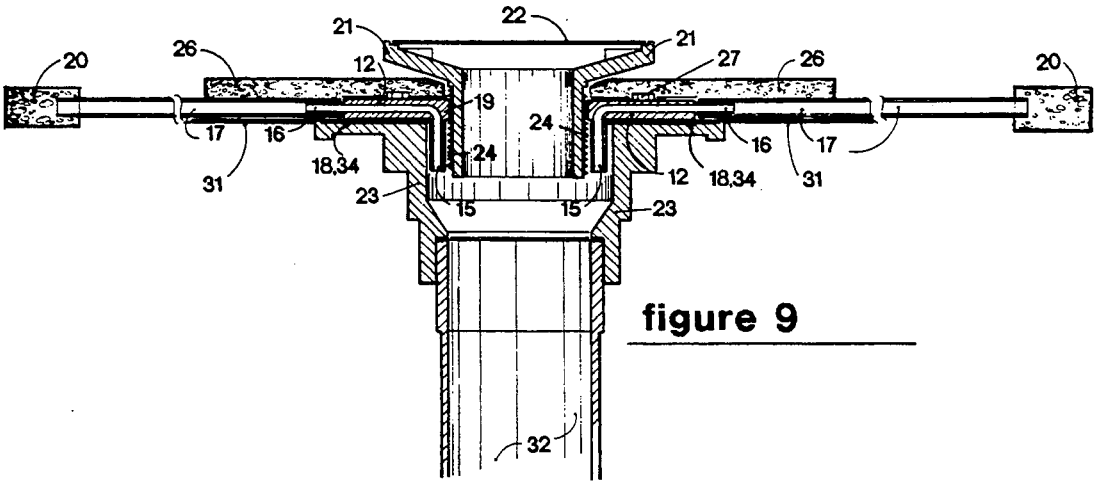
FIG. 9 is a cross-sectional side view of the assembled floor drain.

In FIG. 9, a cross-sectional side view of the assembled floor drain, the floor drain housing 23 is connected to existing plumbing drainage 32 by solid weld fitting 25. The boss receptacle 34 on top of the floor drain housing 23 receives the boss 18, and the fit of the special tongue and groove creates a waterproof membrane seal between the floor drain housing 23, the waterproof liner 31, and the flange clamp ring 12. Tapered barb fittings 16, which provide a water-tight seal, attach one end of each of the siphonage drain lines 17 to the main flange clamp ring 12. A permeable cap 20 encloses each of the other unattached ends of the open-ended siphonage drain lines 17. The adjustable strainer 21, which passes through port protector 26, has a grate cover 22.

Figure 10:
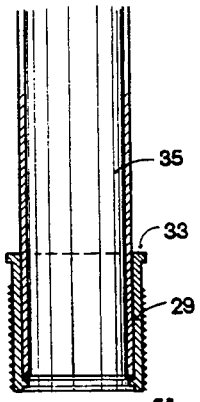
FIG. 10 is a cross-sectional side view of the transition fitting.

FIG. 10 shows a cross-sectional side view of a transition fitting 29 and with a flange stop 33. This transition fitting 29 can be used to adapt the previously-described invention to conventional floor drains, such as preformed pans and custom-built showers.

Although the invention has been described and illustrated in the above preferred embodiment, the invention is not intended to be limited only to that description. Those skilled in the art will recognize that variations and modifications can be made without departing from the scope of the invention.

What is claimed is:

1. A filtering device for preventing foreign solid material from entering and blocking drainage holes in a floor drain apparatus, comprising:

(a) a floor drain housing having an upper surface with a groove, said floor drain housing being connected to a drainage pipe;

(b) a waterproof liner with a central opening of a diameter sufficient to accommodate a cylindrical drain segment, said liner disposed on the upper surface of the floor drain housing;

(c) a flange clamp ring, with a rim projecting downwardly from its circumference, said rim formed for inserting in the groove of the floor drain housing, and said flange clamp ring having an upper surface and an outer sidewall;

(d) means for boltably affixing said flange clamp ring to the floor drain housing;

(e) a flat, torus-shaped member of porous, flexible material permeable to liquids, said member having a central opening of a diameter sufficient to accommodate a cylindrical drain segment, said member also having a cavity of substantially the same shape as said flange clamp ring such that said member covers the upper surface of the clamp ring and surrounds said outer sidewall flange clamp;

(f) the cylindrical drain segment with a flanged rim extending outwardly from an upper peripheral edge of said cylindrical drain segment, said cylindrical drain segment capable of being screwed into said flange clamp ring;

(g) a drain member;

(h) means for attaching said cylindrical drain segment to said drain member.

2. A drainage device for a floor drain comprising:

(a) a flange clamp ring, having horizontal surfaces and a vertical periphery;

(b) a multiplicity of drain holes passing through said horizontal surfaces of said flange clamp ring;

(c) a multiplicity of drain tubes disposed within said flange clamp ring, each of said drain tubes having a receiving end passing through the vertical periphery of said flange clamp ring and a discharging end passing through the lower horizontal surface of said flange clamp ring; and (d) means for boltably affixing said flange clamp ring to a floor drain housing.

3. A drainage device for a floor drain comprising:

(a) a flange clamp ring, having horizontal surfaces and a vertical periphery;

(b) a multiplicity of drain holes passing through the horizontal surfaces of said flange clamp ring;

(c) four drain tubes spaced at 90 degrees (90°) intervals about the circumference of said flange clamp ring and disposed within said flange clamp ring, each of said drain tubes having a receiving end passing through the vertical periphery of said flange clamp ring and a discharging end passing through the lower horizontal surface of said flange clamp ring;

(d) four drain lines;

(e) means for attaching each of said drain lines to the receiving end of one of said drain tubes;

(f) four porous, flexible permeable members, each permeable member enclosing an unattached end of each of said drain lines; and (g) means for boltably affixing said flange clamp ring to a floor drain housing.

4. Floor drain apparatus comprising:

(a) a floor drain housing having an upper surface with a groove, said floor drain housing being connected to a drainage pipe;

(b) a waterproof liner with a central opening of a diameter sufficient to accommodate a cylindrical drain segment, said liner disposed on the upper surface of the floor drain housing;

(c) a flange clamp ring, with a rim projecting downwardly from its circumference, said rim formed for inserting in the groove of the floor drain housing, and said flange clamp ring having horizontal surfaces and a vertical periphery, and with a multiplicity of drain holes passing through the horizontal surfaces of said flange clamp ring, and a multiplicity of drain tubes disposed within said flange clamp ring, each of said drain tubes having a receiving end passing through the vertical periphery of said flange clamp ring and a discharging end passing through the lower horizontal surface of said flange clamp ring, and with a multiplicity of drain lines, with means for attaching each of said drain lines to the receiving end of one of said drain tubes, and a multiplicity of porous, flexible permeable members, each permeable member enclosing an unattached end of each of said drain lines;

(d) means for boltably affixing said flange clamp ring to the floor drain housing;

(e) a flat, torus-shaped filtering member of porous, flexible permeable material, said member having a central opening of a diameter sufficient to accommodate the cylindrical drain segment;

(f) the cylindrical drain segment, with a funnel-shaped portion extending upwardly from its upper end, said drain segment capable of being inserted through said filtering member and, by screwing means, screwed into said flange clamp ring;

(g) a perforated grate covering the upper end of said cylindrical drain segment;

(h) bolting means for affixing said grate to the upper end of the cylindrical drain segment 5. Floor drain apparatus comprising:

(a) a floor drain housing having an upper surface with a groove, said floor drain housing being connected to a drainage pipe;

(b) a waterproof liner with a central opening of a diameter sufficient to accommodate a cylindrical drain segment, said liner disposed on the upper surface of the floor drain housing;

(c) a flange clamp ring having horizontal surfaces and a vertical periphery, and with a rim projecting downwardly from its circumference, said rim formed for inserting in the groove of the floor drain housing, and said flange clamp ring with a multiplicity of drain holes passing through the horizontal surfaces of said flange clamp ring, and a multiplicity of drain tubes disposed within said flange clamp ring, each of said drain tubes having a receiving end passing through the vertical periphery of said flange clamp ring and a discharging end passing through the lower horizontal surface of said flange clamp ring and with a multiplicity of drain lines, with means for attaching each of said drain lines to the receiving end of one of said drain tubes, and with a multiplicity of porous, flexible permeable members, each permeable member enclosing an unattached end of each of said drain lines;

(d) means for boltably affixing said flange clamp ring to the floor drain housing;

(e) a flat, torus-shaped filtering member of porous, flexible permeable material, said member having a central opening of a diameter sufficient to accommodate the cylindrical drain segment;

(f) the cylindrical drain segment with a flanged rim extending outwardly from an upper peripheral edge of said cylindrical drain segment, said cylindrical drain segment capable of being screwed into said flange clamp ring;

(g) a drain member;

(h) means for attaching said cylindrical drain segment to said drain member.

* * * * *